United States Patent [19]

Midorikawa

[11] 4,119,756

[45] Oct. 10, 1978

[54] METHOD OF MANUFACTURING A MARKING PEN HAVING A NIB AND AN INK RESERVOIR INTEGRAL THEREWITH

[75] Inventor: Yoshio Midorikawa, Tokyo

[73] Assignee: Glasrock Products, Inc., Fairburn, Ga.

[21] Appl. No.: 694,525

[22] Filed: Jun. 10, 1976

[51] Int. Cl.[2] ..... B43K 1/12; D04H 3/14

[52] U.S. Cl. ..... 428/295; 156/180; 156/296; 156/305; 156/306; 264/128; 401/198; 427/244; 428/297; 428/304; 428/394

[58] Field of Search ..... 156/77, 87, 155, 180, 156/305, 296, 306; 401/198, 199, 215; 427/243, 244; 264/128; 428/295, 297, 304, 394

[56] References Cited

U.S. PATENT DOCUMENTS

| | | | |
|---|---|---|---|
| 3,400,998 | 9/1968 | Daugherty et al. | 401/198 |
| 3,432,446 | 3/1969 | Coppeta | 260/2.5 |
| 3,443,984 | 5/1969 | Stewart | 264/174 X |
| 3,461,197 | 8/1969 | Lemelson | 264/172 |
| 3,502,417 | 3/1970 | Hartmann | 401/202 |
| 3,558,392 | 1/1971 | Goodenow et al. | 401/198 X |
| 3,562,374 | 2/1971 | Okamoto et al. | 264/128 |
| 3,715,254 | 2/1973 | Tolgyesi | 156/180 |
| 3,767,520 | 10/1973 | Dick et al. | 401/198 |
| 3,864,183 | 2/1975 | Hori | 156/180 |
| 3,881,828 | 5/1975 | Jones | 401/199 |
| 3,942,903 | 3/1976 | Dickey et al. | 401/215 X |

FOREIGN PATENT DOCUMENTS

| | | | |
|---|---|---|---|
| 800,211 | 12/1968 | Canada | 401/198 |
| 1,561,844 | 4/1970 | Fed. Rep. of Germany | 401/198 |
| 1,418,087 | 10/1965 | France | 401/198 |
| 44-26687 | 11/1969 | Japan | 401/198 |

*Primary Examiner*—Michael R. Lusignan
*Attorney, Agent, or Firm*—Lane, Aitken, Dunner & Ziems

[57] ABSTRACT

A fibre bundle is first formed from loosely entangled fibres. Then, the fibre bundle is encased in a plastic shell and dipped into a solution of a synthetic resin in a solvent to fill the spaces among fibers with the solution. After taken out of said solution it is left to stand for a period of time during which the volatilization of the solvent forms a great number of capillary passages for the transudation of ink. After grinding a marking pen is obtained having a nib and an ink reservoir integral therewith.

9 Claims, 5 Drawing Figures

METHOD OF MANUFACTURING A MARKING PEN HAVING A NIB AND AN INK RESERVOIR INTEGRAL THEREWITH

BACKGROUND OF THE INVENTION

The present invention relates to method of manufacturing a marking pen having a nib and an ink reservoir integral therewith.

DESCRIPTION OF THE PRIOR ART

A nib for a marking pen produced from fibres has been manufactured by a method wherein thin fibres are gathered together at a high density for close contact with each other, then these fibres are connected by gluing or fusion to form a fibre bundle, with the very small spaces left between the fibres constituting a great number of capillary passages which are used as ink transudation passages. However, the above method has basic disadvantages in that the gluing or fusion is not always performed in a completely satisfactory manner and further the formation of the ink transudation passages requires very precise and difficult techniques.

SUMMARY OF THE INVENTION

Therefore, the object of the invention is to provide a new method of manufacturing a marking pen including a nib and an ink reservoir integral therewith.

The another object of the invention is to provide method of manufacturing a marking pen cheaply and simply.

The above objects are, in accordance with the present invention accomplished by a method including the steps of forming a fibre bundle of loosely entangled fibres, covering or coating the fibre bundle around its periphery with an outer shell of a suitable material, dipping a portion of the fibre bundle into a solution of a synthetic resin in solvent to fill the spaces among the fibres with the solution, removing from the solution leaving the fibre bundle to set while allowing the solvent, to valatilize thus forming a great number of ink transudation holes or capillary passages in the synthetic resin impregnated portion substantially longitudinally along the paths of the escaping volatilized gas.

DESCRIPTION OF THE PREFERRED EMBODIMENTS

Figure 2:
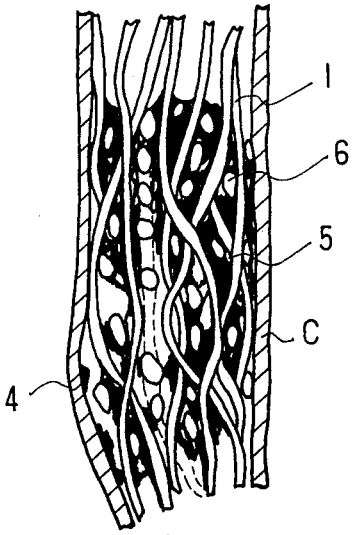
FIG. 2 is a longitudinal section of the fibre bundle for the nib of the present invention.
Figure 3:
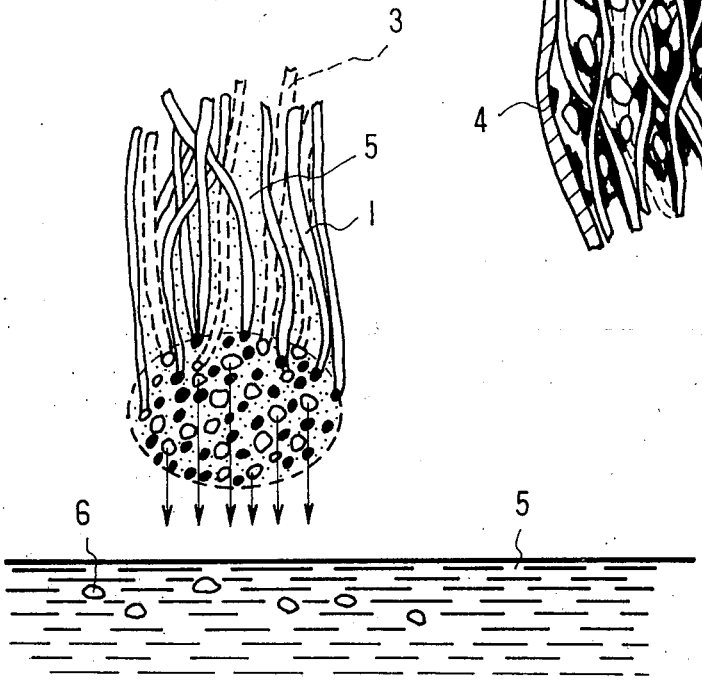
FIG. 3 is a perspective view of the fibre bundle after dipping into a resin/solvent solution.
Figure 4:
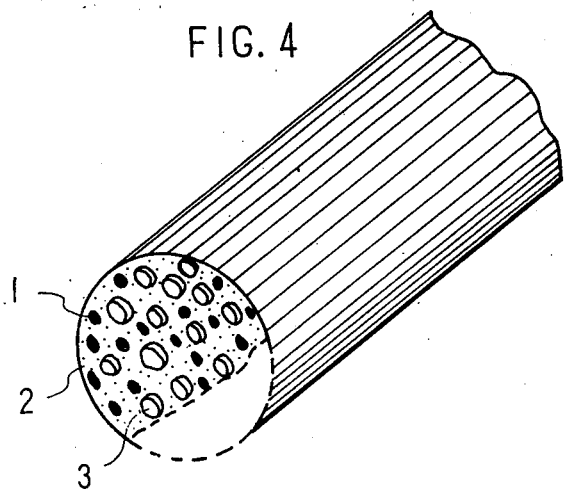
FIG. 4 is a perspective view of the fibre bundle prior to the machining or grinding operation.
Figure 5:
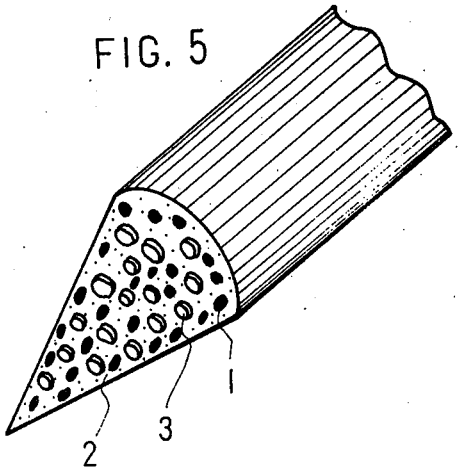
FIG. 5 is a perspective view of the finished nib of the present invention.

Referring to FIG. 2, the method of the present invention is first initiated by forming a fibre bundle 4 of fibres 1 such as a synthetic fibre or glass fibre. However, when forming such a fibre bundle 4 no close compaction of fibres is required as in the previously described prior art. Then, the fibre bundle thus formed is dipped into a solution 5 of a synthetic resin in a solvent as shown in FIG. 3. Instead of the above dipping operation the resin may be sprayed onto the fibre bundle.

In practise, in order to provide an outer shell of a moderate rigidity the fibre bundle 4 is coated around its periphery with a suitable plastic by use of an extruder or is melted only at its surface. From the viewpoint of workability and cost, vinyl chloride is preferred for the outer shell. Then the fibre bundle is cut to a predetermined length for the subsequent dipping or spraying opration.

Thus the fibre bundle 4 which is impregnated with the solution 5 including resin and solvent 6 is dried and hardened in an oven (not shown) due to the setting of resin and at the same time the solvent 6 is volatilized substantially longitudinally along the fibres, resulting in the formation of a great number of substantially longitudinal capillary passages 3. These passages or holes 3 have very complicated configurations which provide very good capillary action as well as moderate rigidity and comfortable elasticity for writing.

Figure 1:
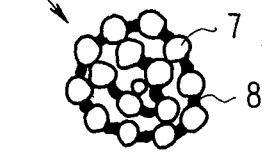
FIG. 1 PRIOR ART
FIG. 1 is a cross sectional view of a conventional nib consisting of fibres connected together by gluing.

On the other hand, as shown in FIG. 1, a conventional nib 9 has a regular and close distribution of the fibres 7 connected together by a gluing agent 8. The nib 9 shown in FIG. 1 has much less complicated configurations of capillary passages or ink transudation holes and much less volume of total capillary passages in comparison with that produced by the present invention and, therefore, poor transudation of ink.

The plastic or synthetic resin which may be used in the present method may be any kind of material provided it is soluble in a solvent, that is, any combination of a solvent and plastic dissolved therein is feasible. However, in order to obtain comfortable flexibility high molecular weight synthetic materials are preferable. For example, we have found that the following composition shown in table I very good results.

Table I

Polyol: 100 parts
Isocyanate: 45 parts
Solvent: 100 parts

Polyol and isocyanate react to produce polyurethane provides proper flexibility and are soluble in hydrocarbon chloride. The combination of plastic and solvent is not restricted to the above example, of course.

The fibre bundle thus treated has two parts, a i.e., treated hardened part and an untreated fibre part. The former forms a nib for the marking pen by grinding or machining to a given shape by use of a suitable tool and the latter forms an ink reservoir consisting of the fibres. A marking or sign pen having a nib and an ink reservoir integral therewith has not been previously provided, but in accordance with the method of the present invention such a product be produced in a single operation which substantially reduces costs and time-consuming labor.

I claim:

1. A method for producing a writing nib material having an integral ink reservoir comprising:

(a) forming a plurality of fibers into a fiber bundle;

(b) cutting said fiber bundle to a predetermined length; then (c) impregnating a first portion of said predetermined length of said fiber bundle with a solution of polymerizable synthetic resin in solvent, leaving a second portion of said predetermined length of said fiber bundle untreated; and (d) allowing said resin in said first portion of said fiber bundle to set whereby the gases generated by volatization of the solvent form capillary passages substantially longitudinally of said bundle.

2. The method of claim 1 wherein the resin is set with heating.

3. The method of claim 1 wherein said fiber bundle is encased in a plastic sheath prior to step b.

4. The method of claim 1 wherein said fiber bundle is impregnated by dipping.

5. The method of claim 1 wherein said fiber bundle is impregnated by spraying.

6. The method of claim 3 wherein said sheath is formed by melting the surface of the fiber bundle.

7. The method of claim 3 wherein said sheath is formed by extrusion.

8. The product formed by the process of claim 1.

9. The product formed by the process of claim 3.

* * * * *

UNITED STATES PATENT AND TRADEMARK OFFICE

CERTIFICATE OF CORRECTION

PATENT NO. : 4,119,756

DATED : October 10, 1978

INVENTOR(S) : YOSHIO MIDORIKAWA

It is certified that error appears in the above-identified patent and that said Letters Patent are hereby corrected as shown below:

Column 2, line 35, before "very" insert --brings--;

line 41, after "polyurethane" insert --which--;

line 53, after "product" insert --may--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*